US005186240A

United States Patent [19]

Kennon et al.

[11] Patent Number: 5,186,240

[45] Date of Patent: Feb. 16, 1993

[54] COIL CLEANSING ASSEMBLY

[75] Inventors: Douglas D. Kennon, Owatonna; Robert G. Anhorn, Medford, both of Minn.

[73] Assignee: King Company, Owatonna, Mich.

[21] Appl. No.: 739,409

[22] Filed: Aug. 2, 1991

[51] Int. Cl.[5] ..... F28G 1/16

[52] U.S. Cl. ..... 165/95; 134/172; 134/199

[58] Field of Search ..... 165/5, 95; 134/172, 134/199

[56] References Cited

U.S. PATENT DOCUMENTS

| | | | |
|---|---|---|---|
| 1,903,650 | 4/1933 | Snow et al. | 165/95 |
| 1,978,555 | 10/1934 | Snow | 165/95 |
| 4,141,754 | 2/1979 | Fraunfled | 134/24 |
| 4,165,261 | 8/1979 | Henstra et al. | 202/241 |
| 4,332,292 | 6/1982 | Garberick | 165/95 |
| 4,528,820 | 7/1985 | Jonasson | 62/80 |
| 4,570,447 | 2/1986 | Jonasson | 62/80 |
| 4,589,898 | 5/1986 | Beaver | 65/12 |

FOREIGN PATENT DOCUMENTS

| | | | |
|---|---|---|---|
| 1132410 | 9/1982 | Canada | 165/95 |
| 478138 | 6/1929 | Fed. Rep. of Germany | 165/95 |
| 72600 | 8/1966 | France | 165/95 |
| 651188 | 3/1979 | U.S.S.R. | 165/95 |
| 503 | of 1866 | United Kingdom . | |

*Primary Examiner*—Allen J. Flanigan

[57] ABSTRACT

A coil cleansing assembly for automated cleaning of dirt and debris from within banks of heat exchanger coils is disclosed. The cleansing assembly is mounted above, below and between banks of such coils to enable focused jets of high velocity spray to impinge upon the surfaces of the coils and, thus, dislodge particles. It can be used with either individually finned tubes or plate fin coves of aluminum, galvanized steel or copper.

Alternative embodiments for the cleansing spray assembly include a rotating arm system with spray ports mounted on a spray supply tube and a longitudinal track arrangement upon which a plurality of wand-type spray bars are mounted for reciprocating travel. Thus, the cleansing system of the present invention provides alternative arrangements for supplying jet-like sprays of water or other cleaning fluid to all regions of a bank or array of finned industrial coils in a multi-bank configuration, which flushes dust and debris from previously difficult to reach areas and ensure enhanced sanitation.

12 Claims, 3 Drawing Sheets

COIL CLEANSING ASSEMBLY

BACKGROUND OF THE INVENTION

I. Field of the Invention

This invention relates generally to the design of cleaning systems for industrial heat-exchanger coil arrays and more particularly to an assembly and mechanism for cleaning layers of finned coils to remove particles of dust and debris that have become entrapped within the joints and crevices of such coil arrays.

II. Discussion of the Prior Art

Prior attempts to thoroughly cleanse all regions of the fins of cooling assemblies using forced spray jets of cleaning fluids have not been entirely successful. It is difficult to access fins embedded within the array to dislodge particles of dirt and debris. Of the two general types of heat exchangers, devices have been designed to clean rotary heat exchangers, but the problem of cleaning stationary banks of heat exchanger coils has not been adequately solved. The present invention solves this problem for stationary heat exchangers by subdividing a lengthy bank into sections and directing jets of cleaning fluid to impinge upon individual fins to dislodge dirt and debris. Due to their rotating nature, rotary heat exchangers address an entirely different application than that of stationary heat exchangers. Also due to their rotating nature, it is necessary that the sprayers directed at rotary systems be positioned along the periphery and utilize directed jets of forced spray. Our experiments have shown that such an approach with stationary heat exchangers fails to cleanse all regions.

In U.S. Pat. No. 4,141,754, issued to Frauenfeld, there is disclosed both apparatus and method for cleaning the heat exchanging surfaces of the heat transfer plates of a rotary regenerative heat exchanger. Generally, ambient heat exchanging gas or air is mixed with a medium pressure jet of cleaning agent and the mixture is directed at high velocity into the interspaces between the heat transfer fins or plates of the rotating heat exchange unit. The high velocity injection of cleanser is accomplished using injection-type nozzles to produce directional jets of steam or gas cleaning agents aimed towards injection tubes. Ambient heat exchanging gas or air is sucked into these tubes along with the cleaning agents, and turbulence therein mixes them. The mixture is then blown upon the interspaces between heat transfer plates using supersonic nozzles.

A method of applying a generally flat, fan-shaped spray to the side and top surfaces of cooling fins is disclosed in U.S. Pat. No. 4,589,898 to Beaver. The invention is directed primarily to the proportional percentages of solvents used and is expressly designed for removing boron oxide contaminants from fin surfaces in a glass fiber forming bushing assembly.

A plurality of coil-cleaning nozzles is disclosed in U.S. Pat. No. 4,332,292 to Garberick. These nozzles are mounted at the ends of highly flexible hoses which, in turn, are connected to relatively rigid supply lines fed from a medium supply source. These flexible tubes are positioned in front of the coil they are intended to clean and can be operated either simultaneously or individually to spray pressurized cleaning medium toward the coil. The nozzle itself is an elongated, relatively narrow slot mounted at the distal end of a highly flexible tube. The tubing selected is so sensitive to pressure that flow of the pressurized cleaning medium causes a "whipping action" that disperses the cleanser fluid.

The stationary finned cooling units currently in use in the food industry are generally larger and bulkier than the rotary units cleansed by the Frauenfeld U.S. Pat. No. '754 device described briefly above. In addition to their non-analogous nature of use, rotary heat exchanger units are inherently more cleanable by a stationary spray head or spray tube because as the unit rotates, most regions of the surface pass into the trajectory of the impinging sprays. In our attempts to devise a system which would clean stationary banks of heat exchanger coils, we have instead found it necessary to provide a mechanism which will move across the surface of such banks. Although it is possible to use the Beaver U.S. Pat. No. '898 and Garberick U.S. Pat. No. '292 sprayers to cleanse stationary, squared banks of layered heat exchanger fins, they are incapable of accessing all regions of the bank to a degree adequate to satisfy, for example, the stringent cleanliness requirements of the food processing industry.

It is accordingly a principal object of the present invention to provide a new and improved method and apparatus for automatic cleansing of layers of stationary, finned industrial coils without the necessity for removal of the coils from their mountings.

Another object of the present invention is to provide a method and apparatus for thoroughly cleansing difficult to reach regions between layers of stationary, finned heat exchanger coils.

It is yet another object of the present invention to provide a method and apparatus for enhancing sanitation in, for example, the food processing industry by providing a means for periodically, automatically and more thoroughly cleaning such finned heat exchanger coil arrays.

A further object of the present invention is to provide a rotating spray arm arrangement that can be interspersed between rows of industrial heat exchanger coils for providing a cleansing spray thereto, and which is capable of cleaning all regions of a bank of coils of substantial depth dimension.

A still further object of the present invention is to provide a method and apparatus for a laterally traversing spray assembly that is interspersed between plural stacked arrays of heat exchanger coils for providing a cleansing spray capable of reaching all regions of the heat exchanger.

SUMMARY OF THE INVENTION

The foregoing objects and advantages of the invention are achieved by providing alternative embodiments of an automated cleansing spray system for use with finned coil-type heat exchangers comprised of supply tubes for water or other cleaning fluids, fitted with focused parallel spray nozzles for cleaning plural modules or arrays of extended surface finned heat exchanger coils comprising a composite heat exchanger. The coil array is typically comprised of spirally finned tubes or plate finned cores of aluminum, galvanized steel or copper. Multiple layers of these serpentine, interlocking finned tubes are typically offset from one another in order to maximize thermal performance and are typically organized into banks of 2–6 layers.

Alternative embodiments for the cleansing spray assembly include a rotating arm system with spray ports mounted on a tubular spray arm and a longitudinal track arrangement upon which a plurality of wand-type, tubular spray bars are mounted for reciprocating travel parallel to the exposed surfaces of the heat exchanger modules. Thus, the cleaning system of the present invention provides alternative arrangements for supplying jet-like sprays of water or cleaning fluid to all regions of plural arrays of finned industrial coils situated in a multi-bank configuration, which flushes dust and debris from previously difficult to reach areas and ensures enhanced sanitation.

The aforementioned objects and advantages of the invention will become subsequently apparent and reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
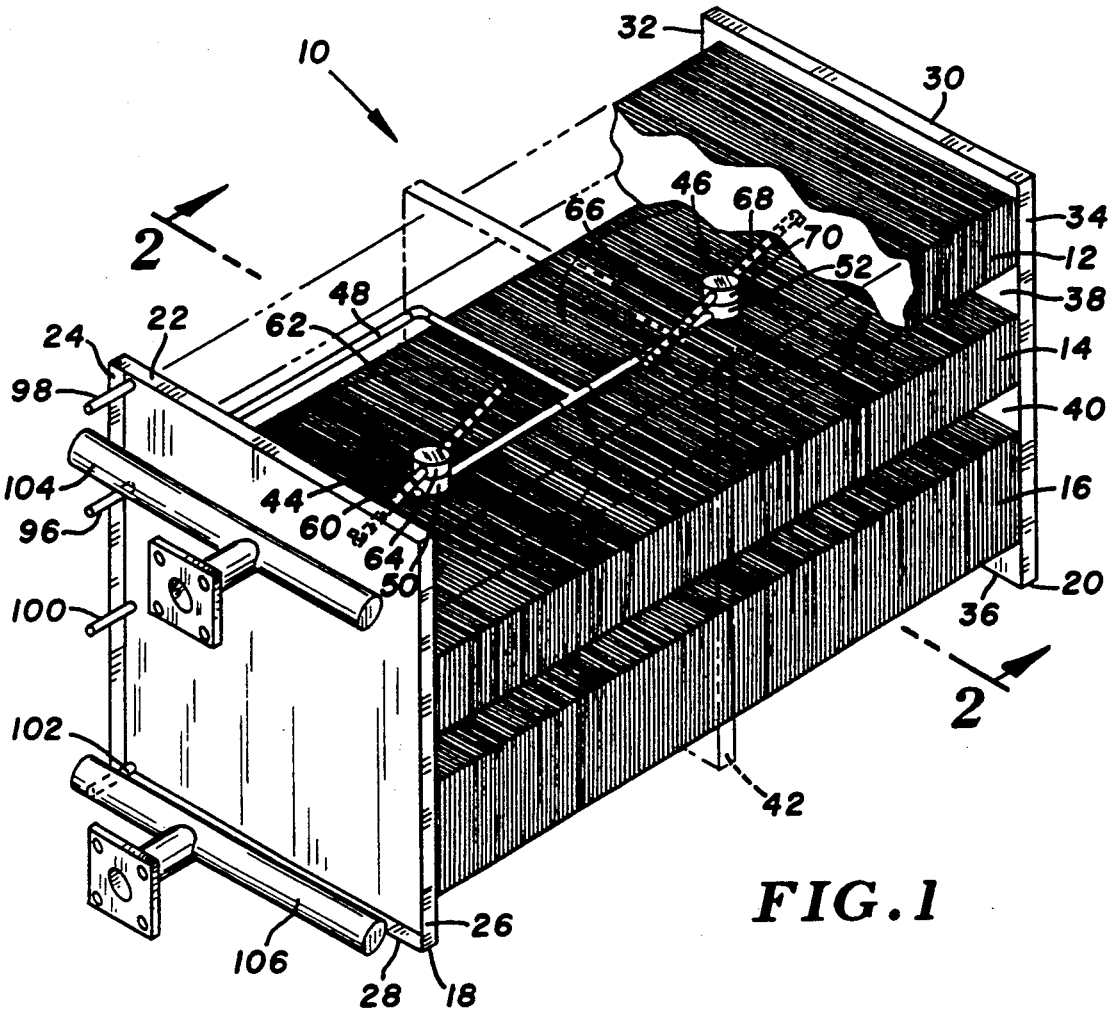
FIG. 1 is a perspective view of a first preferred embodiment of the present invention cooperating with a multi-bank arrangement of finned heat exchanger coils.
Figure 2:
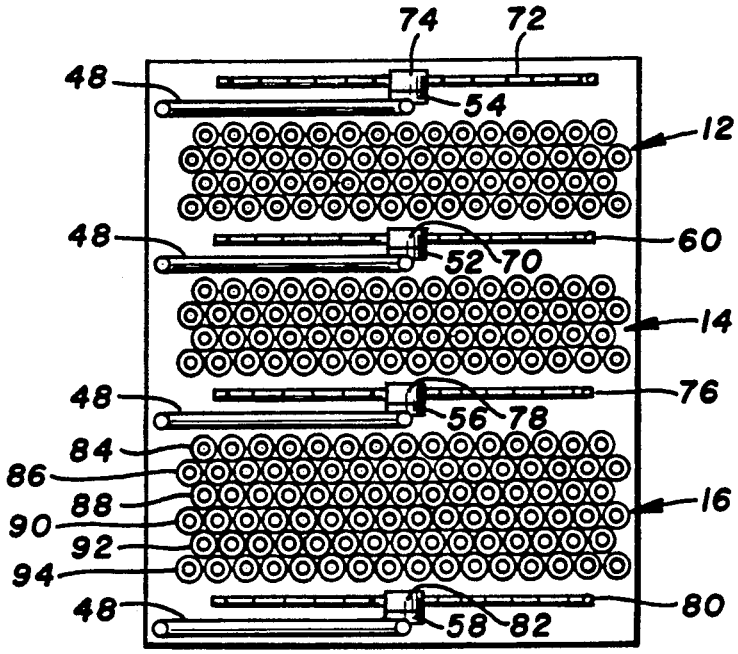
FIG. 2 depicts a side cross-sectional view of the embodiment of FIG. 1 taken along the line 2—2 in FIG. 1.

A preferred embodiment of the coil cleaner assembly 10 of the present invention is shown in FIG. 1 in combination with a heat exchanger which requires periodic cleaning. The heat exchanger is shown as consisting of three banks 12, 14, 16 of standard finned heat exchanger coil modules that are supported in parallel relationship between tubesheet end mounts 18 and 20. Those skilled in the art will recognize that any reasonable number of these banks, e.g. between two and four, may be used and that the three banks depicted herein are for illustrative purposes only. Tubesheet end mount 18 has a top flange 22, side flanges 24 and 26 and a bottom flange 28. Similarly, tubesheet end mount 20 has a top flange 30, side flanges 32 and 34 and a bottom flange 36. The banks 12, 14 and 16 are affixed to tubesheet mounts 18 and 20 in parallel, spaced relation which provides the gaps 38 and 40 between banks 12 and 14 and between banks 14 and 16, respectively. As best seen in FIG. 2, the gaps 38 and 40 are proportioned to permit placement of spray arms (FIG. 3) between banks 12 and 14 and between banks 14 and 16, as well as above the top bank 12 and below the bottom bank 16, if so desired. Typically, banks of heat exchanger coils may be assembled to a depth of approximately 24 to 60 inches, a width of approximately 24 to 70 inches and a length of approximately 48 to 240 inches. Coil banks in excess of 84 inches in length may require the presence of one or more tubesheets such as shown in dotted line form at 42 and which are parallel to the tubesheet end mounts 18 and 20 to provide additional support. Side cover 42 is shown centrally positioned perpendicular to the banks 12, 14 and 16. Those skilled in the art will appreciate that the number of tubesheets required is dependent upon the length of the coils, and each section between tubesheets would require additional spray arm assemblies, as described herein.

Referring to FIG. 1, one set of rotatable spray arm assemblies 44, 46 is visible positioned within gap 38. Additional pairs are positioned in parallel relationship within gap 40 as well as above the coil bank 12 and below the coil bank 16, as more clearly seen in FIG. 2. Each pair of spray arms has a main liquid supply line, as at 48 in FIG. 1. The supply lines for each spray arm connects to a commercially available all-purpose rotary union as at 50 and 52 (FIG. 1) of the type available from the Deublin Company of Northbrook, Illinois. Although the view in FIG. 2 only permits one of each pair of spray arm assemblies to be seen, rotary unions 54, 56 and 58 are visible. Spray arms 60 and 62 are affixed to rotary union 50 with retainer cap 64 holding them in place. Similarly, spray arms 66 and 68 are affixed to rotary union 52 with retainer cap 70. FIG. 2 shows a pair of spray arms 72 held on rotary union 54 by retainer cap 74, spray arms 76 held on rotary union 56 by retainer cap 78, and spray arms 80 held on rotary union 58 by retainer cap 82.

Each coil bank 12, 14 and 16 is comprised of individual layers of individual, interlocking serpentine coils to which the closely spaced, parallel heat exchanger fins are conductively joined. As best seen in the cross-sectional view of FIG. 2, each of the three banks of coils 12, 14 and 16 is comprised of individual layers of finned coils, exemplified by layers 84, 86, 88, 90, 92 and 94. These individual layers 84 through 94 may be juxtaposed in laterally off-set relation to one another to minimize the space occupied. Although six layers have been depicted, it should be appreciated that the present invention has been determined to be capable of cleaning banks of coils in the range of approximately two to six layers deep.

Referring again to the main supply pipe 48, it is dimensioned to extend through tubesheet end mount 18, leaving a section of pipe 96 exposed. Similarly, sections 98, 100 and 102 extend through tubesheet end mount 18 to provide the attachment of a cleaning fluid supply to the sets of spray arm assemblies disposed within gap 40, above the top bank 12, and below the bottom bank 16. Each exposed inlet tube section 96, 98, 100 and 102 of the supply pipes 48 is positioned to avoid interference with the refrigerant supply header assemblies identified by numerals 104 and 106.

Figure 3:
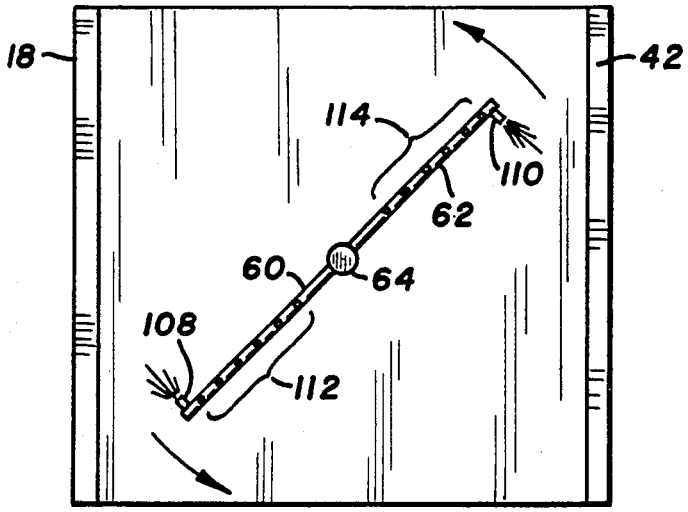
FIG. 3 depicts a top view of one rotary arm of the embodiment of FIG. 1.

Turning now to FIG. 3, spray arms 60 and 62 and retainer cap 64 comprising a single spray arm assembly are visible. Spray nozzles 108 and 110 are positioned at opposing ends of the spray arms 60 and 62, and are directed within the plane of rotation of the spray arms 60 and 62 to impart an angular momentum by a jet of water or cleansing liquid exiting the assembly. The retainer 64 of rotary union 50 can be seen affixed at a point on spray arms 60 and 62 so that spray nozzles 108 and 110 will be equidistantly placed from retainer 64. Spray nozzles 108 and 110 are preferably suited to high pressure washing, such as the commercially available WashJet® high impact solid stream nozzle available from Spraying Systems Co. of Wheaton, Illinois. This placement at opposing ends of the spray arms 60 and 62 is advantageous, since it obviates the need for motorized propulsion, which has a propensity for breakdown in the preferred sub-zero or otherwise adverse environment to which these devices are frequently exposed.

To ensure maximum coverage of the coil surfaces, the nozzles 108 and 110 can be accompanied by a plurality of smaller spray nozzles 112 and 114, the number of which is dependent upon the length of the spray arm 60 or 62. It is suggested from experiments that a large number of small nozzles performs better than a lesser quantity of large nozzles. The plurality of smaller nozzles 112 and 114 are directed perpendicular to the plane of rotation of the spray arms 60 and 62, for imparting high pressure jets of liquid cleaning agent to the banks of coils. By virtue of the positioning of spray arms 60 and 62 within gap 38, it is necessary that a similar row of spray nozzles (not shown) also lines the undersides of spray arms 60 and 62. This positioning of spray nozzles provides cleansing liquid spray to the underside of coil bank 12 and the upperside of coil bank 14 simultaneously. Similarly, the pair of spray arms 76 are fitted with top and bottom rows of spray nozzles to provide cleansing spray to the underside of coil bank 14 simultaneously with a similar spray to the upper side of coil bank 16. A single row of spray nozzles positioned on the underside of the pair of spray arms 72 bathes the top of coil bank 12. A single row of spray nozzles is positioned on the upper side of the pair of spray arms 80 to bathe the bottom of coil bank 16. Thus, each pair of spray arms is rotated to provide a cleansing spray to all regions of the coil banks 12, 14 and 16.

It should be evident to one skilled in the art that the rows of individual spray nozzles which line the spray arms may be positioned so that individual spray nozzles are slightly offset from one another. Thus, a row of spray nozzles may be mounted on the spray arms wherein a first nozzle is offset, for example two degrees clockwise, from the large propulsion nozzle mounted at the end of the spray arm and a second nozzle is offset two degrees clockwise from the first nozzle. Consecutive spray nozzles, each with a two degree offset, thus direct jets of cleansing fluid at slightly different angles from the plane of rotation transcribed by movement of the spray arms.

In operation, an external source of cleaning liquid supplies each rotating spray arm assembly 44, 46, 72, 76, 80 via pipe inlet sections 96, 98, 100 and 102. The exit pressure of this liquid as it emits from the nozzles, such as 108 and 110 at the distal ends of spray arms 60 and 62, provides the propelling force which causes each spray arm to rotate in a direction opposite from the direction of emission of spray. The smaller spray nozzles, such as 112 and 114, simultaneously emit high velocity jets of cleaning liquid which impinge upon the surfaces of the finned coils with sufficient momentum to mechanically dislodge and remove particles of dirt and debris which may have accumulated between the fins. The velocity of the liquid emitted through the large nozzles determines the velocity of rotation of the spray arms and, simultaneously, the velocity with which the impinging jets of cleaning fluid strike the surfaces of the finned coils.

ALTERNATIVE EMBODIMENT

Figure 4:
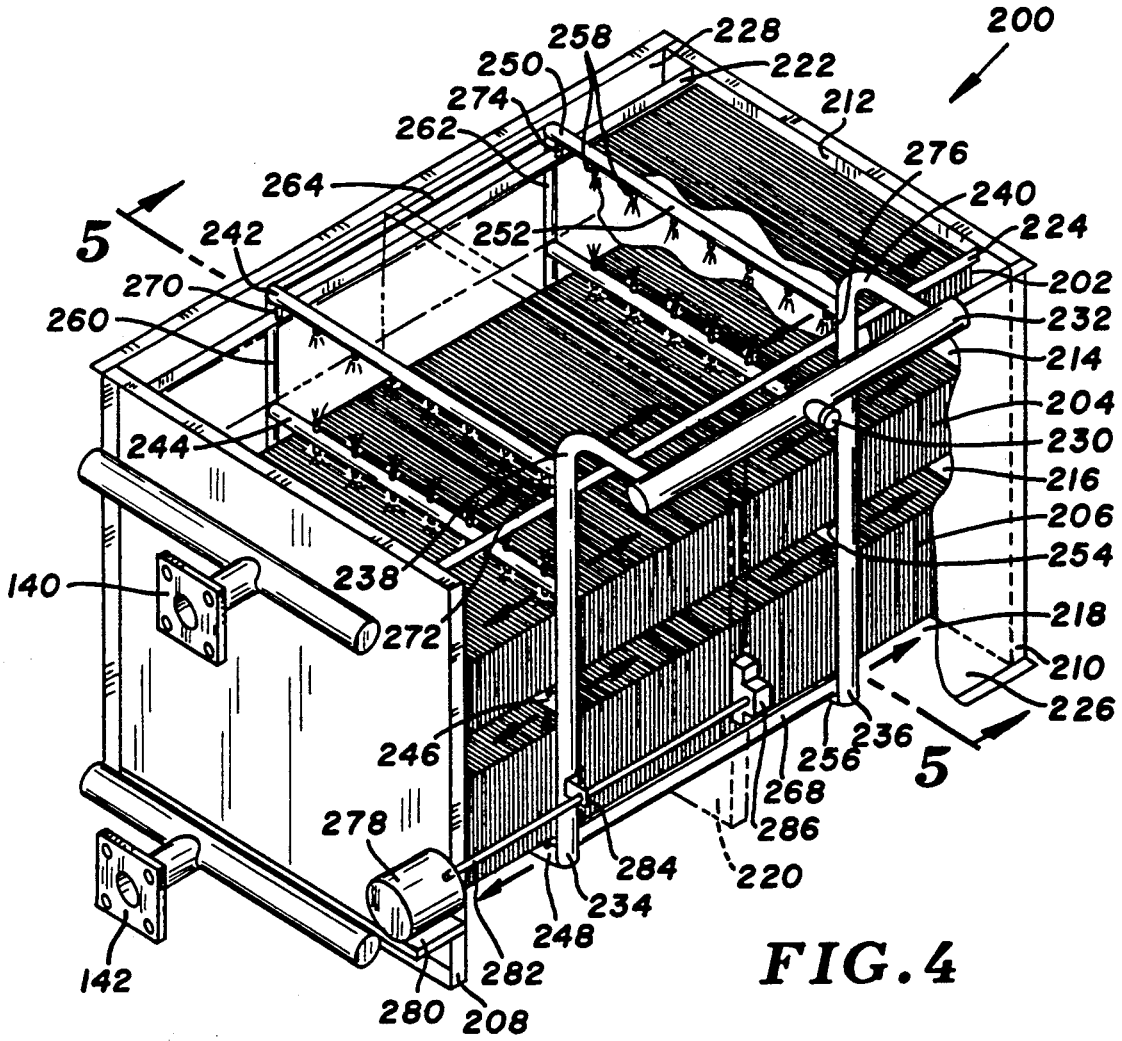
FIG. 4 is a perspective view of an alternative embodiment of the present invention cooperating with a typical array of finned heat exchanger coils.

An alternative embodiment of the present invention featuring a reciprocally movable assembly for translational movement of spray arms is generally depicted as 200 in FIG. 4. As previously mentioned, illustrative multiple banks 202, 204 and 206 of standard finned heat exchanger coil modules are supported in parallel relationship on tubesheet end mounts 208, 210 in a manner that provides gaps 212, 214, 216 and 218 between the coil banks 202 and 204, between coil banks 204 and 206, as well as between bank 202 and the top of the tubesheet end mounts 208 and 210, and between coil bank 206 and the floor upon which the device rests. As described previously, at least one tubesheet end mount 220 may be centrally positioned for providing support parallel to the tubesheet end mounts 208 and 210 to prevent sagging. Depending upon the length of the coils, a plurality of sprayer assemblies, one interspersed between each pair of tubesheets, may be required, as in the embodiment of FIG. 1. A pair of support rails 222 and 224 run between and perpendicular to the tubesheet end mounts 208 and 210, and contribute to the rigidity of the structure. The assembly is protected by front and rear walls 226 and 228 formed from sheet metal.

The spray assembly is comprised of a series of pipes to distribute water or other cleaning fluid throughout the unit. More specifically, an inlet port 230 mounted on a transverse header pipe 232 receives fluid from an external source (not shown) and distributes it between the two sections of the assembly that are separated from one another by tubesheet 220. A pair of riser pipes 234 and 236 are mounted on alternate ends of the transverse header pipe 232 and each has an elbow, or is bent as at 238 and 240, which enables these riser pipes to extend parallel to the front wall 226 of the assembly. The riser pipes 234, 236 receive the fluid from transverse pipe 232 and disperse it among spray arms 242, 244, 246, 248 and 250, 252, 254, 256, respectively. Spray nozzles 258 are mounted on the underside of spray arms 242 and 250, on the top of spray arms 248 and 256 and on both the tops and bottoms of spray arms 244, 246, 252 and 254.

Vertical support rods 260 and 262 are rigidly affixed to spray arms 242–254 and may be either hollow pipes for additional dispersement of fluid or solid rods. A horizontal support brace 264 runs from the junction of spray arm 242 and support rod 260 along rear wall 228 through an access port (not shown) in tubesheet 220 to the junction of spray arm 250 and support rod 262. A parallel support brace (not shown) runs along rear wall 228 from the junction of spray arm 248 and support rod 260 through a similar access port (not shown) in tubesheet 220 to the junction of spray arm 254 and support rod 262. Yet another support brace 268 runs along front wall 226 from the junction of spray arm 248 and riser pipe 234 to the junction of spray ar 256 and riser pipe 236 and passing in front of tubesheet 220. A fourth support brace (not shown) from riser pipe 234 to riser pipe 236 near coil array 202 is optional.

Figure 5:
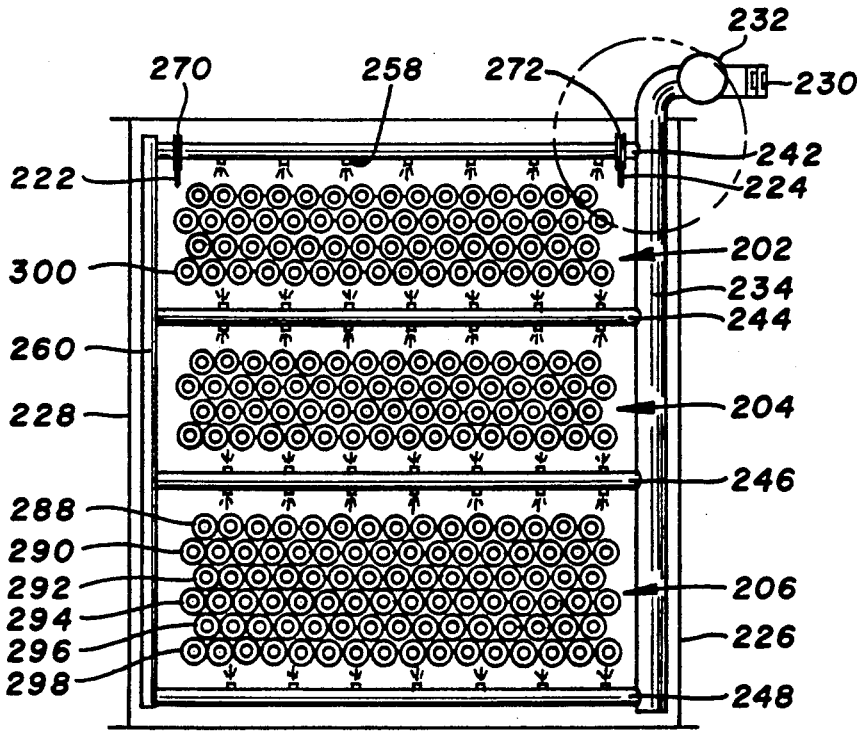
FIG. 5 depicts a side-cross sectional view of the embodiment of FIG. 4 taken along the line 5—5 in FIG. 4.
Figure 6:
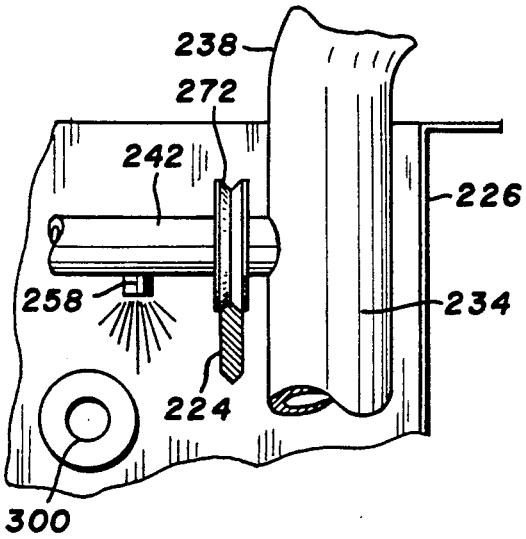
FIG. 6 is a partial and somewhat enlarged perspective view of a portion of the sprayer assembly of the embodiment of FIG. 4.

Wheels 270 and 272, which are best seen in FIGS. 5 and 6, are journaled for rotation on opposing ends of spray arm 242. Wheels 274 and 276 are similarly journaled on opposing ends of spray arm 250. The wheels 272 and 276 are dimensioned to receive the upper edge of support rail 224, as shown in greater detail in FIG. 6. The wheels 270 and 274 are similarly dimensioned to receive the upper edge of support rail 222. Thus, the entire assembly of delivery pipes 232 through 256 can travel back and forth as a unit on support rails 222 and 224.

Movement of this assembly may be achieved by various mechanisms, such as using reversible motor 278 supported on bracket 280. Threaded rod 282 extends from motor 278 along the front of coil array 206.

Bracket 284 having a threaded bore or a mating ball nut is rigidly mounted upon riser pipe 234 for cooperating with the threaded rod 282. An additional bracket 286 is securely affixed to tubesheet 220 for journaling the distal end of threaded rod 282.

FIG. 5 shows a side view of the coil cleansing assembly of the present invention, from the perspective attained when tubesheet end mount 208 is removed. Spray arms 242, 244, 246 and 248 are mounted between vertical support rod 260 and riser pipe 234. As in FIG. 2, each coil bank 202, 204 and 206 is comprised of individual layers 288, 290, 292, 294, 296, 298 of interlocking, serpentine coils 300 onto which parallel heat exchanger fins are conductively joined. One skilled in the art will recognize that standard plate fins may also be used without deviating from the spirit of the present invention.

The interlocking relationship between support rail 224 and wheel 272 mounted on spray arm 242 is depicted in FIG. 6. The angular construction of support rail 224 and similarly dimensioned wheel 272 ensures that the cleansing assembly 200 will remain on its track during its travel.

Figure 7:
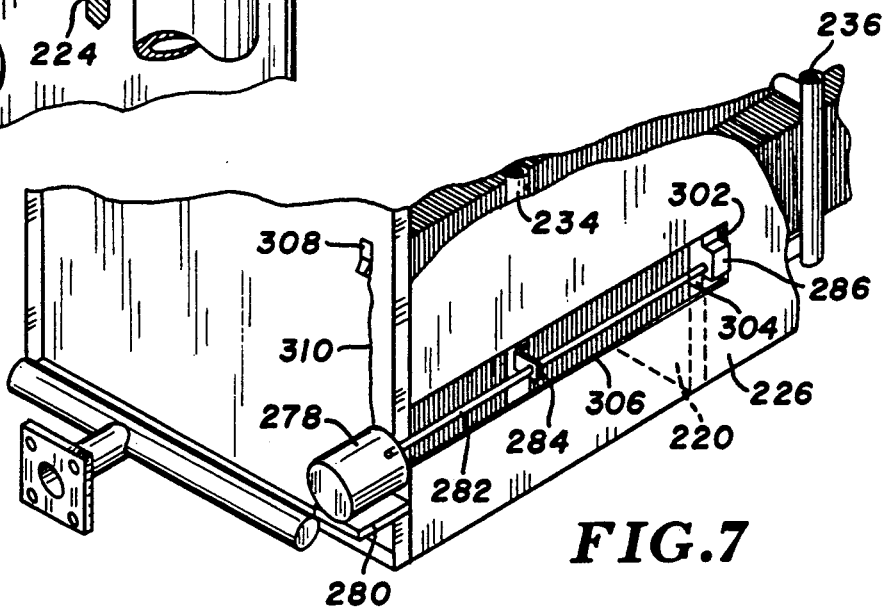
FIG. 7 is a further partial perspective view showing the interrelationship between the front cover and the traversing rod assembly of the sprayer assembly embodiment of FIG. 4.

FIG. 7 depicts a portion of the cleansing assembly 200 with it front sheet metal cover 226 in place. A step 302 is dimensioned in bracket 286 to enable its base 304 to be mounted on tubesheet 220, yet protrude through a slot 306 dimensioned in front cover 226 to receive threaded rod 282 from reversible motor 278. Similarly, bracket 284 with its ball nut extends outside of front cover 226, whereupon it receivably engages threaded rod 282. This configuration minimizes the exposure of the motor 278 and threaded rod 282 assembly to the cleaning liquids emitted from the spray nozzles 258 during use.

Switch 308 is electrically joined by electrical cable 310 to reversible motor 278. In operation, when switch 308 is turned to its "on" position, reversible motor 278 rotates threaded rod 282, thus causing bracket 284 to first be moved laterally away from motor 278. Due to its rigid affixation to riser pipe 234, the entire sprayer assembly 200 is shifted laterally, at a rate proportional to the speed of reversible motor 278. Thus, the individual jets of cleaning liquid emitted from spray nozzles 258 are made to perpendicularly impinge upon the surfaces of the coil banks 202, 204 and 206 and upon the individual coil layers, such as layers 288 through 298, dislodging dirt and debris from these surfaces. The ball nut supporting bracket 284 continues along its path within opening 306 in front cover 226 until its movement is arrested by contact with end bracket 286. Such contact operates a limit switch (not shown) to cause motor 278 to reverse its direction of rotation, whereupon the sprayer assembly 200 is caused to move toward motor 278. This process continues until switch 308 is displaced to an "off" position.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures, can be accomplished without departing from the scope of the invention itself.

What is claimed is:

1. A coil cleansing assembly for cleaning dirt and debris from within the stationary banks of a multi-bank heat exchanger of the type in which each bank includes a plurality of fluid carrying tubes of a predetermined length extending parallel to one another and having closely-spaced, parallel-oriented heat transfer fins operatively coupled to said tubes and extending transverse to the length dimension of said tubes, comprising in combination:

(a) a pair of support walls supporting said plurality of tubes; and (b) a cleaning fluid delivery means for spraying cleaning fluid on said stationary banks of a multi-bank heat exchanger, said cleaning fluid delivery means being disposed between adjacent banks of said multi-bank heat exchanger, and having:

(i) conduit means, each having a first and second end and a midsection, with a cleaning fluid inlet port at each of said first ends, and said midsections being disposed between said adjacent banks, for transporting cleaning fluid, (ii) spraying means dispersed between said first end and said second end along said midsection of each of said conduit means, for causing cleaning fluid to impinge on said heat exchanger at high velocity, and (c) a carriage means for joining said plurality of conduit means in parallel orientation at said first and second ends, and (d) drive means coupled to said cleaning fluid delivery means for imparting translating motion to said conduits relative to said heat exchanger banks, allowing said conduits to move as a unit, whereupon cleaning fluid exiting said spraying means impinges upon said banks of said heat exchanger to remove accumulated dirt and debris from between said heat transfer fins.

2. The coil cleansing assembly as in claim 1, wherein said cleaning fluid delivery means further includes a plurality of individual spraying jets rigidly affixed to each of said plurality of spraying means to cause cleaning fluid to forcefully impinge upon said heat exchanger.

3. The coil cleansing assembly as in claim 1, wherein said means for supporting translational motion comprises a reversible motor for moving said cleaning fluid delivery means transversely, as a unit, across said bank of heat exchanger coils.

4. The coil cleaning assembly as in claim 1, wherein said drive means for imparting translational motion to said conduits comprises:

(a) a reversible motor;

(b) a motor support means for supporting said reversible motor at a predetermined position relative to said heat exchanger banks;

(c) a lead screw having first and second ends, said reversible motor means coupled in driving relation to said lead screw at said first end;

(d) a threaded rod bearing means positioned at said second end of said lead screw for journaling said lead screw for rotation; and (e) means for coupling said cleaning fluid delivery means to said lead screw for causing said cleaning fluid delivery means to move reciprocally relative to said banks of heat exchangers as said threaded rod is rotated.

5. A coil cleansing assembly for cleaning dirt and debris from within stationary banks of a multibank heat exchanger comprising in combination:

(a) a pair of stationary support walls having a first heat exchanger bank affixed therebetween;

(b) a cleaning fluid supply means having an inlet port; and (c) a cleaning fluid delivery means having:

(i) a first rigid conduit means having a first end and a second end and a midsection, said inlet port being coupled to said first end with said midsection being disposed between said support walls above said first heat exchanger bank, (ii) a second rigid conduit means having a first end and a second end and a midsection, said inlet port being affixed to said first end and said midsection disposed between said support means below said heat exchanger bank, (iii) spraying means dispersed between said first end and said second end along said midsection of each of said first and second rigid conduit means, (iv) drive means connected to said cleaning fluid delivery means for moving same across said first heat exchanger bank and causing said spraying means to impinge cleaning fluid upon said first bank to remove accumulated dirt and debris therefrom, and (v) a four-wheel carriage assembly affixed to said first and second rigid conduit means and affixed to said drive means.

6. A coil cleansing assembly as in claim 5, wherein said cleaning fluid delivery means further includes a plurality of spraying means disposed above, below and between adjacent ones of said heat exchanger banks.

7. A coil cleansing assembly as in claim 4, wherein said drive means further includes a reversible motor means for transversely moving said carriage means as a unit over said bank of heat exchanger coils.

8. The coil cleansing assembly as in any one of claim 1 or 5, wherein said bank of heat exchanger coils is comprised of a number of layers of heat exchanger coils in a range of two layers to six layers.

9. The coil cleansing assembly as in any one of claims 1 or 5, wherein said pair of support walls holds a number of banks of heat exchanger coils therebetween in a range of two banks to four banks.

10. The coil cleansing assembly as in claim 5, wherein said drive means for moving said spraying means comprises:

(a) a reversible motor;

(b) a motor support means for supporting said reversible motor at a predetermined position relative to said heat exchanger banks;

(c) a lead screw having first and second ends, said reversible motor means coupled in driving relation to said lead screw at said first end;

(d) a threaded rod bearing means positioned at said second end of said lead screw for journaling said lead screw for rotation; and (e) means for coupling said cleaning fluid delivery means to said lead screw for causing said cleaning fluid delivery means to move reciprocally relative to said banks of heat exchangers.

11. A coil cleansing assembly for cleaning dirt and debris from within banks of a multi-bank coil heat exchanger, of the type having a plurality of fluid carrying tubes extending between a pair of support walls and having a plurality of closely-spaced heat conducting metal fins joined to said fluid carrying tubes in heat conducting relation, comprising in combination;

(a) a pair of stationary support walls having at least one rigid bank of heat exchanger coils affixed therebetween, said bank of heat exchanger coils being comprised of a number of layers of heat exchanger coils in a range of two layers to six layers, and said pair of support walls holding a number of banks of heat exchanger coils therebetween in a range of two banks to four banks, (b) a cleaning fluid supply means for providing cleaning fluid from a reservoir, said cleaning fluid supply means having an inlet port; and (c) movable cleaning fluid delivery means for spraying cleaning fluid on each of said banks of heat exchanger coils, said movable cleaning fluid delivery means being affixed to said cleaning fluid supply means and disposed for forcefully applying cleaning fluid to said banks of heat exchanger coils, whereby debris is removed from said tubes and said fins, said moveable cleaning fluid delivery means having:

(i) conduit means for transporting cleaning fluid, said conduit means having a first and second end and a midsection, with a cleaning fluid inlet port at said first end, and said midsection being disposed above and below said at least one bank, and said second end being secured to a stabilizing means for permitting said conduit means to move as a unit across said bank of heat exchanger coils, (ii) a plurality of spraying means for causing cleaning fluid to impinge upon said at least one bank of heat exchanger coils, dispersed between said first end and said second end along said midsection of said conduit means, and (c) drive means coupled to said cleaning fluid delivery means for imparting translating motion to said conduit means relative to said at least one heat exchanger bank, allowing said conduit means to move as a unit, whereupon cleaning fluid exiting said spraying means impinges upon said at least one bank of said heat exchanger to remove accumulated dirt and debris from between said heat transfer fins.

12. The coil cleansing assembly of claim 11, wherein a plurality of spraying jets are affixed to said plurality of spraying means to cause said cleaning fluid to forcefully impinge upon said at least one heat exchanger bank.

* * * * *